US006646606B2

(12) United States Patent
Mikkola et al.

(10) Patent No.: US 6,646,606 B2
(45) Date of Patent: Nov. 11, 2003

(54) DOUBLE-ACTION ANTENNA

(75) Inventors: Jyrki Mikkola, Kempele (FI); Suvi Tarvas, Oulu (FI)

(73) Assignee: Filtronic LK Oy, Kempele (FI)

( * ) Notice: Subject to any disclaimer, the term of this patent is extended or adjusted under 35 U.S.C. 154(b) by 0 days.

(21) Appl. No.: 09/981,545

(22) Filed: Oct. 17, 2001

(65) Prior Publication Data

US 2002/0044091 A1 Apr. 18, 2002

(30) Foreign Application Priority Data

Oct. 18, 2000 (FI) ..... 20002300

(51) Int. Cl.[7] ..... H01Q 1/38

(52) U.S. Cl. ..... 343/700 MS; 343/702; 343/725

(58) Field of Search ..... 343/700 MS, 702, 343/725, 729, 829, 846, 872, 895, 900, 893

(56) References Cited

U.S. PATENT DOCUMENTS

| | | | | |
|---|---|---|---|---|
| 5,764,190 A | * | 6/1998 | Murch et al. | 343/700 MS |
| 5,892,483 A | | 4/1999 | Hayes et al. | |
| 5,940,038 A | | 8/1999 | Brown | |
| 6,204,819 B1 | * | 3/2001 | Hayes et al. | 343/700 MS |
| 6,211,830 B1 | * | 4/2001 | Monma et al. | 343/702 |
| 6,222,496 B1 | * | 4/2001 | Liu | 343/700 MS |
| 6,225,951 B1 | * | 5/2001 | Holshouser et al. | 343/700 MS |

FOREIGN PATENT DOCUMENTS

| | | | |
|---|---|---|---|
| EP | 1021603 | 12/2000 | H01Q/1/24 |
| FI | 952406 | 5/1995 | H01Q/9/00 |
| SE | 9903372-2 | 7/2001 | H01Q/1/24 |
| WO | 01/20716 | 3/2001 | H01Q/1/24 |
| WO | 01/37371 | 5/2001 | H01Q/1/24 |

* cited by examiner

*Primary Examiner*—Don Wong
*Assistant Examiner*—Shih-Chao Chen
(74) *Attorney, Agent, or Firm*—Darby & Darby

(57) ABSTRACT

A double-action antenna structure includes, e.g. a PIFA-type antenna inside the casing of a mobile station, a coupling element and a moveable whip element. The coupling element is a relatively small conductive element between the radiating plane and ground plane of the PIFA, galvanically isolated from the radiating plane and ground plane. When the whip element is retracted, it has no significant coupling to the PIFA parts. When the whip element is extended, its lower end is galvanically connected to the coupling element so that a significant electromagnetic coupling is established between the whip element and the radiating plane of the PIFA. Thus the whip element is fed through the PIFA without being in galvanic contact with it. The coupling element further provides for the matching of the whip element. The internal and external antennas may be designed and optimized relatively independently of each other.

7 Claims, 3 Drawing Sheets

FIG. 2
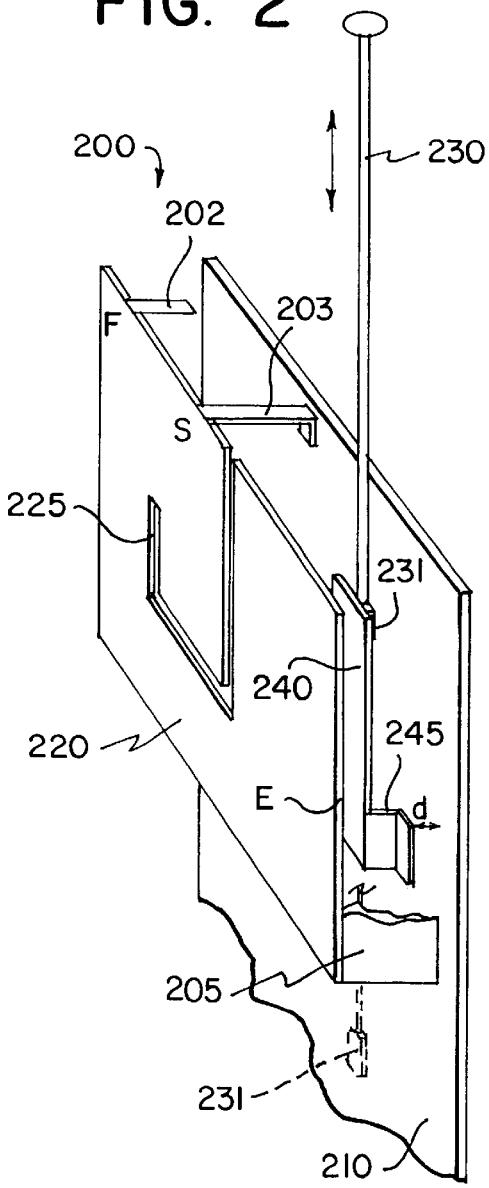
FIG. 3
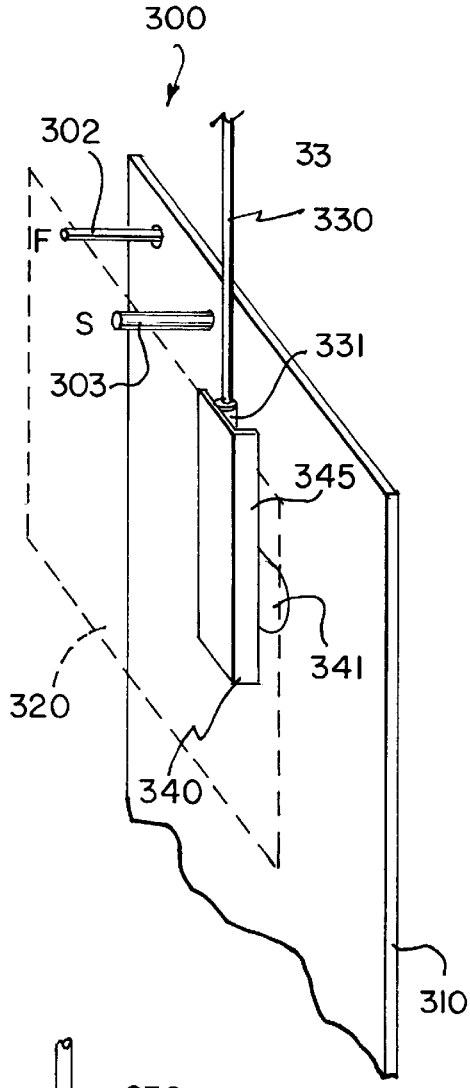
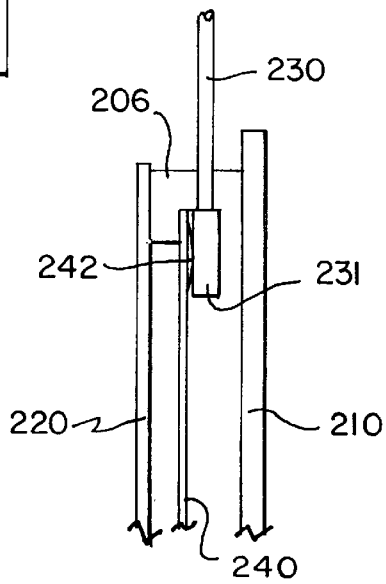
FIG. 4

DOUBLE-ACTION ANTENNA

FIELD OF THE INVENTION

The invention relates to double-action antenna structures suitable in particular for mobile stations, in which structures one component is a retractable whip element.

BACKGROUND OF THE INVENTION

In the field of portable radio equipment, mobile stations in particular, the manufacture of antennas has become demanding. As new frequency bands are introduced, an antenna often has to function in two or more frequency bands. When the devices are small, the antenna, too, must be small; preferably it is placed inside the casing of the apparatus, thus avoiding an impractical protrusion. Understandably, however, the radiation characteristics of an internal antenna are weaker that those of an external antenna. Moreover, an internal antenna is more sensitive to the effect of the hand of the user, for example. These disadvantages can be reduced using a double-action antenna so that a movable antenna element belonging to the structure can be pulled partly out when necessary in order to improve the quality of the connection.

A retractable whip element is well known as such. If the antenna structure additionally comprises a second radiating element, it is usually an element outside the casing of the apparatus, considerably shorter than the whip element. Such a double-action antenna, which in one operating state is located completely inside the casing of the apparatus, is disclosed in an earlier patent application FI991359 by the same applicant. The structure is depicted in FIG. 1. It comprises a ground plane 110, radiating planar element 120, feed conductor 102 and a short-circuit conductor 103, which constitute the PIFA (Planar Inverted F Antenna) type portion of the whole antenna, located inside the casing of the radio apparatus. The planar element 120 has a slot 121 in it, which is shaped such that the resonance frequency of the planar antenna is as desired. The structure further includes a whip element 130, at the lower end of which there is a connecting piece 131. When the whip is in its lower position, it has no significant coupling with the PIFA parts. When the whip is in its upper position, the connecting piece 131 is in galvanic contact with the planar element 120 on both sides of the slot 121 so that the slot becomes short-circuited. Short-circuiting the slot considerably increases the resonance frequency of the planar antenna, whereby the planar antenna will not function as an antenna in the operating frequency band when the whip is in the pulled-out position. The whip element is so dimensioned that it will function as a monopole antenna in the same operating frequency band, thereby replacing the internal planar antenna. The task of the planar element 120 is then to function as a part in the feed line of the whip and as an impedance-matching element of the whip. The PIFA may also be arranged to have two frequencies so that in its upper position the whip element changes e.g. the lower resonance frequency of the PIFA in such a manner that only the pulled-out whip functions as the radiating element at the lower operating frequency. Then the conductive plane of the PIFA functions as the radiating element at the upper operating frequency. Alternatively, the pulled-out whip element just makes the operation of the antenna more efficient at the lower operating frequency without changing the resonance frequency of the PIFA.

SUMMARY OF THE INVENTION

It is an object of the invention to provide a double-action antenna in a novel and more advantageous manner than in known structures. The antenna structure according to the invention is characterized by what is specified in the independent claim 1. Some advantageous embodiments of the invention are presented in the dependent claims.

The basic idea of the invention is as follows: An antenna structure comprises e.g. a PIFA-type antenna located inside the casing of a mobile station, a coupling element and a whip element movable in relation to the former two. The coupling element is a relatively small conductive plane between the radiating plane and ground plane of the PIFA. When the whip element is retracted, it has no significant coupling with the PIFA parts. When the whip element is extended, its lower end is brought into galvanic contact with the coupling element, whereby a significant electromagnetic coupling is established by means of the coupling element between the whip element and the radiating plane of the PIFA. Thus the whip element is fed through the PIFA without a galvanic contact with it. In addition, the coupling element provides for the matching of the whip element. The internal antenna may have one or more frequency bands. In the case of a dual-band antenna, for example, the extended whip improves the operation of the antenna structure in both bands of the internal antenna.

An advantage of the invention is that in the structure according to it the internal and external antenna can be designed and optimized relatively independently. This is due to the fact that the design of the internal antenna need not take into account the matching of the whip antenna when the matching is realized by the coupling element. Another advantage of the invention is that the structure according it is relatively simple and inexpensive since there is no need for separate mechanical parts or components for the matching. A further advantage of the invention is that the structure according to the invention decreases the size of the internal antenna. This is because the coupling element which is placed under the outer end, as viewed from the short-circuit point, of the radiating plane, causes additional capacitance and, hence, decreases the physical size in relation to the electrical size.

BRIEF DESCRIPTION OF THE DRAWINGS

The invention is described in detail in the following. Reference is made to the accompanying drawings in which FIG. 2 shows an example of the antenna structure according to the invention, FIG. 3 shows another example of the antenna structure according to the invention, FIG. 4 shows an example of the whip element coupling according to the invention.

DETAILED DESCRIPTION OF THE INVENTION

Figure 1:
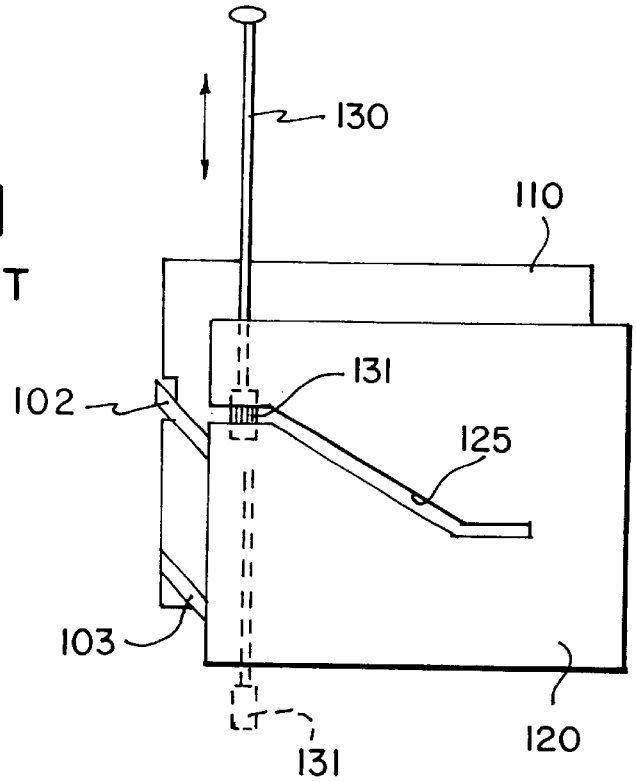
FIG. 1 PRIOR ART
FIG. 1 shows an example of an antenna structure according to the prior art.

FIG. 1 was already discussed in conjunction with the description of the prior art.

FIG. 2 shows an example of the antenna structure according to the invention. The antenna structure 200 comprises a ground plane 210, a radiating planar element 220 parallel therewith, a whip element 230 and a coupling element 240. To the radiating planar element at its point F is galvanically connected the feed conductor 202 of the whole antenna structure, and at another point S a short-circuit conductor 203 which connects the radiating planar element to ground 210. Thus the planar portion of the antenna structure is in this example of the PIFA type. The radiating planar element 220 has a slot 225 in it, which divides the element, viewed from the feed point F, into two branches which have different lengths. Therefore, the PIFA in this example is a dual-band PIFA. The coupling element 240 is a strip-like conductive plane between the radiating planar element and ground plane, parallel therewith, having at its lower end a projection 245 bent towards the ground plane. At the end of the projection 245 there is a bend parallel with the ground plane, at a distance d from the ground plane. There is naturally an electromagnetic coupling between the coupling element and the radiating planar element. The coupling element is located near that edge E of the radiating planar element which is electrically farthest away from the short-circuit point S and is parallel with the said edge. Then, as the planar antenna resonates, its electric field is the strongest in the vicinity of the coupling element 240 and therefore the aforementioned coupling is mainly capacitive.

The "lower end" of a structural part means in this description and in the claims the outermost end in the retraction direction of the whip element and has nothing to do with the operating position of the device. Similarly, the "upper end" of a structural part refers to the end opposite to the lower end.

The whip element 230 is movable along its axis. In FIG. 2 the whip element is depicted in its upper position, i.e. extented. In this case, the connecting piece 231 at its lower end is in galvanic contact with the coupling element 240 at the upper end thereof. This arrangement provides for both the feed and the impedance matching of the whip element: Together with the coupling element the whip element forms at its operating frequency a resonator which gets its energy capacitively through the coupling between the coupling element and the radiating planar element. On the other hand, the shape and placement of the coupling element as well as the selected connecting point of the coupling element and whip element determine the matching in such a manner that the whip radiates (and receives) as effectively as possible. FIG. 2 further shows in broken line the whip element in the lower position, i.e. retracted. The whip element with its connecting piece 231 is then isolated from all conductive structural parts and it has no significant coupling with the other parts of the antenna structure.

In the example of FIG. 2 the radiating planar element 220 is a rigid conductive plate that can be supported to the ground plane 210 by means of a dielectric frame, for example. Shown in the figure is a portion 205 of such a frame. Instead of a rigid plate, the radiating planar element may be a conductive area on the surface of the printed circuit board, for instance.

FIG. 3 shows another example of the antenna structure according to the invention. The structure 300 comprises a ground plane 310, a radiating planar element 320 parallel therewith, depicted only in broken line in the figure, a whip element 330 and a coupling element 340. To the radiating planar element at its point F is galvanically connected the feed conductor 302 of the whole antenna structure, and at another point S a short-circuit conductor 303 which connects the radiating planar element to signal ground. The structure differs from that of FIG. 2 in that the coupling element is located closer to the center of the planar antenna, whereby the electromagnetic coupling between it and the radiating planar element is more inductive than in FIG. 2. The coupling element includes a bend 345 directed towards the ground plane, which bend has a length equalling that of the whole coupling element. On that side of the bend which faces the ground plane there is an extension 341 substantially parallel with the ground plane so that the matching of the whip antenna can be tuned by bending the extension. In this example, the short-circuit conductor 303 in the radiating planar element is a cylindrical protrusion of the ground plane 310. Instead of being a rectangular sleeve the connecting piece 331 of the whip element is a barrel-shaped element.

FIG. 4 shows a detail of the structure according to FIG. 2. It shows an example of how the whip element is connected to the coupling element when the whip is in the extended position. The figure shows in side view the upper parts of the ground plane 210, radiating planar element 220 and coupling element 240, and the connecting piece 231 of the whip element as well as the lower part of the whip 230. At the upper part of the coupling element there is at least one curved contact spring 242. The connecting piece 231 or the extended whip is pressed between the contact springs of the coupling element and the dielectric support material 206. The support material 206 is attached to the ground plane 210 and, furthermore, to the radiating planar element 220 and coupling element 240.

Figure 5:
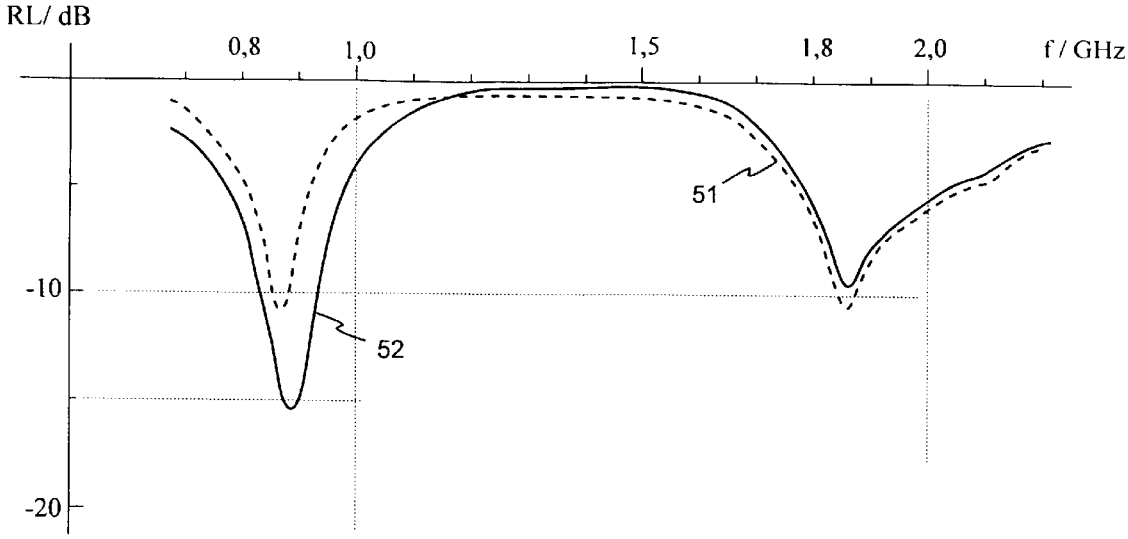
FIG. 5 shows an example of the frequency characteristics of an antenna according to the invention.

FIG. 5 shows an example of the frequency characteristics of the antenna structure according to the invention as depicted in FIG. 2. The figure shows two curves 51 and 52. Curve 51 represents the reflection losses RL of the antenna structure as a function of the frequency, when the whip element is retracted, and curve 52 represents the reflection losses when the whip element is extended. The smaller the reflection losses, i.e. the lower the curve, the more effectively the antenna radiates and receives. Both curves include two "dips", which means the structure in question is designed to operate in two frequency bands. The lower operating band is in the 900-MHz range and the upper operating band in the 1800-MHz range, extending above 2 GHz. Comparing the curves we can see that the extending of the whip element clearly reduces reflection losses of the antenna structure in the lower operating band. The bandwidth is approximately doubled and the radiation efficiency increases, too. In the upper operating band, the extending of the whip element results in a small increase in the reflection losses of the antenna.

Figure 6:
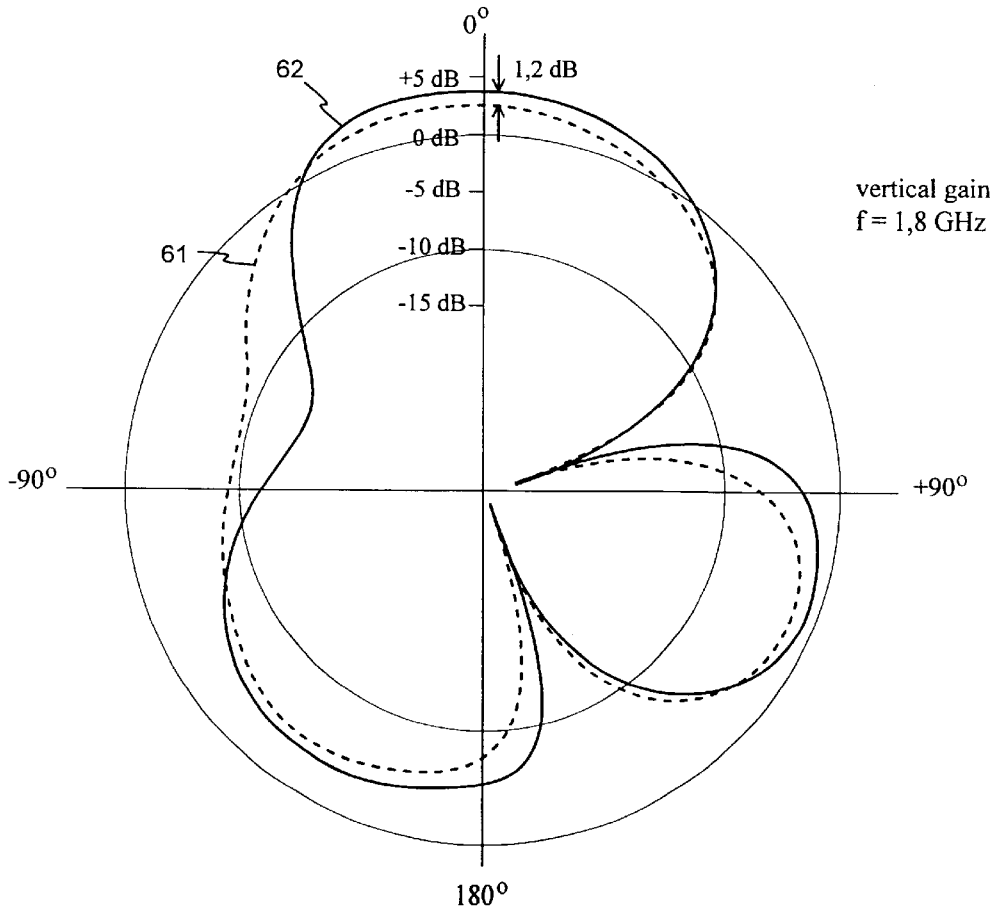
FIG. 6 shows an example of the directional characteristics of an antenna according to the invention, and FIGS. 7*a,b* show an example of a mobile station equipped with an antenna according to the invention.

FIG. 6 shows an example of the directivity pattern of the same antenna structure as in FIG. 5. Curve 61 represents the gain of the antenna structure as a function of the direction angle, when the whip element is retracted, and curve 62 represents the gain when the whip element is extended. The result is measured from the vertical electric field strength at the frequency of 1.8 GHz. It shows that in the direction of the main lobe the extending of the whip element enhances the antenna gain by 1.2 dB, and the field strength is increased in the side lobes as well. This shows that a whip element according to the invention makes the operation of the antenna structure more efficient also in the upper operating band.

Figure 7A:
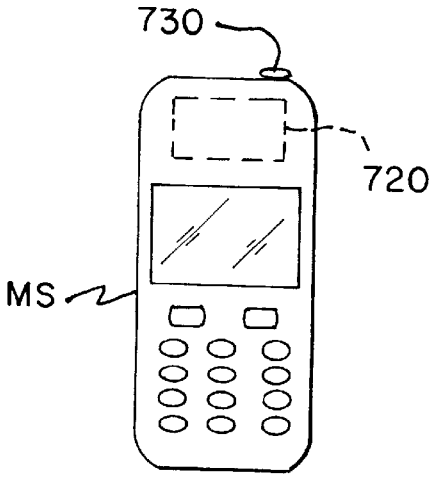
Figure 7B:
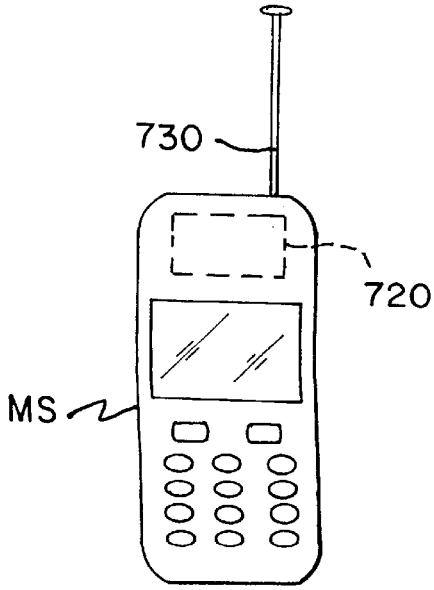

FIGS. 7*a* and *b* show a mobile station (MS) with an antenna structure according to the invention. A radiating planar element 720 in the structure is located completely inside the casing of the mobile station. In FIG. 7*a* the whip element 730 is retracted position within the casing of the mobile station, and in FIG. 7*b* it is extended. In the latter situation, the whip element has a coupling according to FIGS. 2 and 3 to the radiating planar element 720.

Above it was described some antenna structures according to the invention. The invention does not limit the antenna element designs to those particular structures. Neither does the invention limit the manufacturing method of the antenna nor the materials used in it. The inventional idea may be applied in different ways within the scope defined by the independent claim 1.

What is claimed is:

1. An antenna structure comprising inside a radio apparatus a radiating planar element and a ground plane, and a whip element movable in relation to them, a feed conductor of which antenna structure is connected to the radiating planar element, the antenna structure further comprising a coupling element between the radiating planar element and the ground plane, galvanically isolated from these two, which coupling element, when the whip element is extended, is galvanically connected to the whip element to feed and match the whip element.

2. The antenna structure according to claim 1, wherein the radiating planar element forms together with the ground plane a PIFA-type antenna, and the coupling element is located near an electrically outermost edge of the radiating planar element, as viewed from the short-circuit point of the PIFA, to produce a capacitive coupling between the coupling element and the radiating planar element.

3. The antenna structure according to claim 1, wherein the coupling element comprises a planar part substantially parallel with the radiating planar element and the ground plane, and a projection of that planar part, directed towards the ground plane to optimize the matching of the whip element.

4. The antenna structure according to claim 3, wherein said projection of the coupling element is near the lower end of the coupling element.

5. The antenna structure according to claim 1, wherein the whip element together with the coupling element is arranged to resonate substantially at least at one same frequency as the radiating planar element.

6. The antenna structure according to claim 1, wherein the radiating planar element is a rigid conductive element.

7. A radio apparatus comprising an antenna structure that has inside the radio apparatus a radiating planar element and a ground plane, and a whip element movable in relation to them, the antenna structure further comprising a coupling element between the radiating planar element and the ground plane, galvanically isolated from these two, which coupling element, when the whip element is extended, is galvanically connected to the whip element to feed and match the whip element.

* * * * *